United States Patent [19]

Johnson

[11] Patent Number: 4,664,198

[45] Date of Patent: May 12, 1987

[54] STRAIGHT-ON FIRE SPRINKLER WITH IMPROVED VALVE LOCKING MECHANISM

[76] Inventor: Kimball W. Johnson, 36 Rocky Hill Rd., Oxford, Mass. 01540

[21] Appl. No.: 817,894

[22] Filed: Feb. 3, 1986

[51] Int. Cl.[4] ..... A62C 37/10

[52] U.S. Cl. ..... 169/38

[58] Field of Search ..... 169/37–41, 169/90

[56] References Cited

U.S. PATENT DOCUMENTS

| | | | |
|---|---|---|---|
| 3,848,676 | 11/1974 | Doherty, Jr. | 169/37 |
| 4,015,665 | 4/1977 | Simons et al. | 169/40 |
| 4,491,182 | 1/1985 | Pieczykolan | 169/38 |
| 4,508,175 | 4/1985 | Pieczykolan | 169/38 |
| 4,596,289 | 6/1986 | Johnson | 169/37 |

*Primary Examiner*—Jeffrey V. Nase

*Attorney, Agent, or Firm*—Herbert L. Gatewood

[57] ABSTRACT

A fire sprinkler head suitable for mounting in a concealed location in the ceiling in a room in a residential dwelling is provided which provides quick and automatic response in the event of a fire. The valve assembly in the sprinkler head is biased to the open mode by means of a positive force, in addition to the force of the fire extinguishing fluid. Nevertheless, the valve assembly is maintained in the closed mode by the valve locking mechanism of the invention until the onset of a fire and the attainment of a predetermined ambient temperature, at which time the locking mechanism is made inoperative. The locking mechanism is maintained in the operative mode until the temperature of the fire melts a heat fusible alloy composition, at which time the locking mechanism or keeper becomes inoperative.

15 Claims, 4 Drawing Figures

STRAIGHT-ON FIRE SPRINKLER WITH IMPROVED VALVE LOCKING MECHANISM

BACKGROUND OF THE INVENTION (1) Field of the Invention

This invention relates, in general, to a new and improved fire extinguishing sprinkler head and, in particular, to a concealed, automatic fire sprinkler head suitable for use in residential dwellings. Even more particularly, this invention relates to a locking mechanism or keeper, for the valve assembly in a fire sprinkler head.

(2) Description of the Prior Art

Sprinkler systems are used extensively to provide automatic fire protection for residential, commercial and public buildings. Nevertheless, for a sprinkler head to qualify as suitable for use in a residential sprinkler system, the sprinkler head must pass many tests, several of which go beyond those normally used for ordinarily commercial/industrial type sprinkler heads. The two greatest distinctions between ordinary and residential type sprinkler heads are the operating speed and specially designed water spray patterns that fire tests have revealed are necessary to combat or extinguish a fire in typical residences. The residential type fire sprinkler head must operate at a faster speed than the ordinary commerical/industrial sprinkler head, the faster the better, as the protection of human life is involved. Thus, there is a keen interest in providing residential sprinkler heads with even shorter times to become operable.

The primary purpose of a fire sprinkler system is to extinguish or, at least, contain a fire prior to the arrival of fire fighters and fire fighting apparatus. The theory behind the use of fire sprinkler systems is that, by preventing a fire from getting out of control, property damage is minimized and, even more importantly, in the case of residential sprinklers, lives can be saved.

At one time, the greatest danger from a fire in the home was being trapped by flames and burned or suffocated by smoke. However, in more recent years, residential dwelling are being furnished with, or contain furnishings and fixtures which, because they are made of, or contain synthetic materials, give off highly toxic fumes when ignited or heated to a sufficient degree. Thus, it has become increasely clear that many fire fatalities result from inhaling toxic fumes produced by the fire rather than from the fire itself or smoke produced thereby.

In many cases, fire victims are overcome by these toxic fumes and die in their sleep long before the fire becomes intense enough to be noticed by inhabitants of the dwelling or by neighbors. The recognition of this problem has lead to the extensive use of heat and smoke alarms for alerting inhabitants of a dwelling that a fire is in progress. The early alert which is provided by these alarm systems enables the inhabitants to leave the dwelling while it is still safe to do so.

The use of smoke and heat detectors, however, does not diminish the importance of a fire sprinkler system. Although individual safety is of prime importance, the loss of one's home and worldly possessions, represents a tragic event. Also, a fire which is out of control represents, in some cases, a potential threat in spreading to adjacent property, thereby endangering the lives of other individuals. A fire out of control also represents a danger to fire fighters and to individuals who may not be able to leave the residential dwelling quickly, or perhaps not even at all, such as might be the case with small children, infants, the ill, handicapped persons, or elderly residents of a nursing home.

An automatic fire sprinkler head, whether of the commercial/industrial type or one for residential dwellings comprises, in general, an elongated tubular-shaped body member which is open at one end, and is connected to a fire extinguishing fluid, e.g., water, line. The other end of the body member is ordinarily maintained closed by a valve assembly which is locked in that closed position by a locking mechanism or means comprising, in part, a heat fusible alloy composition of low melting point, until the onset of a fire. When a fire occurs, and the ambient temperture reaches some predetermined level, corresponding to the melting point of the alloy composition used, the alloy melts, resulting in the inactivation of the locking mechanism and freeing the valve assembly to move to its open position whereby the fire extinguishing liquid is then discharged from the fire sprinkler head.

Over the years, various locking means have been used, to maintain the valve assembly in a fire sprinkler head, in the closed position. Exemplary of this prior art are U.S. Pat. Nos. 4,015,665; 4,491,182; and 4,508,175.

As disclosed in U.S. Pat. No. 4,015,665, the outlet of the sprinkler head orifice body disclosed therein is normally closed by a valve cap and the valve cap is held in that closed position, until the onset of a fire, by what is termed a "latch assembly", which assembly includes a so-called "latch bar". The latch bar, in one embodiment of the invention as shown in FIG. 1 in that patent, is an elongated, horizontally disposed member which at one end is forked and is provided with a pair of projections. These projections engage an annular lip or abutment which borders the lower edge of a circumferential groove formed in the downwardly extending flange of the orifice body. The other end of the latch bar is provided with a bore or recess in which is located a slug of a low melting point, fusible alloy. At the outer end of the slug, there is formed a depression for a ball, which projects outwardly from and beyond the end of the latch bar. Thus, the ball is engaged with the annular lip or abutment, at a location directly opposite from that engaged by the projections at the other end of the latch bar. When a fire occurs, and the ambient temperature rises to the point where the fusible alloy melts, the ball is caused to move inwardly of the recess, thereby snapping over the edge of the lip or abutment, to release the latch bar.

In a further embodiment, shown in FIG. 5 in U.S. Pat. No. 4,015,665, the latch bar is of a modified construction wherein the recess communicates with a downwardly extending threaded opening. A housing containing a fusible alloy is threaded within the opening whereby, in combination with the bore, there is defined an L-shaped passage. Three balls are located within the passage whereby the inner ball is located partially within a depression in the fusible alloy and the outer ball is engaged with the annular lip or abutment formed in the flange on the orifice body. The engagement of the outer ball with the abutment can be made tight by threading the housing upwardly in the threaded opening of the bore. The housing containing the fusible alloy, being directly exposed to any fire, according to the patentee, results in a faster rate of response than where the fusible element is located well above the ceiling, behind a decorative plate.

In both U.S. Pat. Nos. 4,491,182 and 4,508,175, the outlet end of the orifice body is maintained closed, until the onset of the fire, by an assembly which includes a valve plug kept in position by directly opposed locking balls, which engage a groove located within the outlet end of the orifice body. The locking balls, in both cases, are forced outwardly against the groove and are kept in that position by the tapered surface of an elongated plunger, which is capable of vertical up and down movement. The elongated plunger is located within a housing which can be threaded upwardly to cause the balls to move upwardly and outwardly against the orifice body groove. Within the housing, at the bottom, is located a heat fusible alloy disc which, in turn, supports the elongated plunger. Upon melting of the heat fusible alloy disc, the plunger drops, allowing the locking balls to move inwardly from the groove, and the valve plug to move vertical downwardly, freeing the outlet end of the orifice body for discharge of fire extinguishing liquid.

Although various fire sprinkler heads invented heretofore have been found satisfactory to a degree, there still remains the quest for ever more sensitive and rapid responding sprinkler heads. Moreover, there is a continual desire that sprinkler heads be provided that not only are capable of fast response, in the event of a fire, but that are of economical construction and simple in operation and design.

SUMMARY OF THE INVENTION

A fire sprinkler head is provided which is of such a construction and design as not only to be of economical construction but also simple in operation. Most importantly, however, is that the fire sprinkler head of the invention is capable of rapid, and positive, response, in the event of a fire.

Quite advantageously, the fire sprinkler head disclosed herein can withstand rough useage and handling, as often occurs with sprinkler installers. A further advantage in the sprinkler head of this invention is that it can be readily restored to operable condition and reused with replacement with few parts. And, this restoration can be accomplished, if desired, without removing the sprinkler head from the system.

The fire spinkler head of this invention, as a further advantage, operates automatically to release fire extinguishing water, or other fire extinguishing liquid, to be discharged therefrom onto a fire when a certain predetermined ambient temperature is reached. The fire sprinkler head disclosed herein can be mounted in the ceiling of a room in such a manner that it is essentially concealed from view whereby the sprinkler head can most desirably be used in residential dwellings without adversely affecting the asthetic features in the surroundings.

In its more basic aspects, the fire sprinkler head of the invention comprises, in operative assembly, an elongated, main body member having a tubular-shaped central passageway therein defined by an inlet end to be connected to a water line and an outlet end for discharge of water onto a fire, an outwardly extending horizontally disposed, circular-shaped flange of predetermined diameter on said body member, adjacent said inlet end, defining a vertically disposed circumferential surface, a thread pattern being provided in said circumferential surface, and an outwardly extending, horizontally disposed, circularshaped flange of a predetermined lesser diameter then said first named flange at said outlet end surrounding the said body member, two spaced-apart openings being provided in said second named circular-shaped flange located on an imaginary diameter of said second named circular-shaped flange, and on opposite sides of said body member; an elongated cylindrical-shaped body shell of predetermined diameter and length having an outer and inner circumferential surface and defining a top opening and a bottom opening, a thread pattern being provided on the inner circumferential surface of said body shell extending downwardly from said top opening to a desired predetermined distance along its length toward the bottom opening, said thread pattern matching with that provided on the said circumferential surface of said first named flange, and a groove being provided in the inner circumferential surface of said body shell adjacent the said bottom opening; a valve assembly operable to a closed position to close off the outlet end of the said body member whereby the discharge of water is prevented until the onset of a fire and operable to an open position from the said closed position allowing water to be discharged from the outlet end, said valve assembly comprising in combination a horizontally disposed circular-shaped deflector plate, a plurality of horizontally disposed, outwardly extending teeth being provided uniformly and in spaced-apart location around the circumference of said circular-shaped deflector plate, a valve body member located centrally on and fixedly supported by said deflector plate which, when the valve assembly is in its closed position, intrudes into said outlet end of the tubular-shaped passageway, means being located on said valve body member for providing positive seal of said outlet end when the said valve assembly is in the closed position, an annular-shaped strut directing member surrounding said elongated, main body member and capable of reciprocal linear movement up and down along a predetermined portion of the length of said elongated body member, two spaced-apart vertically disposed, elongated struts of predetermined length connected to said strut directing member at their top ends on an imaginary diameter that coincides with the diameter on which said two spaced-apart opening are located in said second-named flange, said struts each extending through respective said spaced-apart openings and being connected at their bottom ends to said deflector plate; a compressible member surrounding said elongated body member and being located between said first named outwardly extending flange on said elongated body member and said strut directing member; and a locking mechanism for keeping said valve assembly in the closed position and said compressible member in its compressed state until the onset of a fire and the attainment of a predetermined ambient temperature comprising a horizontally disposed means which comprises means providing contact with said groove in the body shell at three uniformly spaced-apart locations, at least one of which means contacting the said groove being an elongated rod capable of reciprocal, horizontal movement back and forth whereby to contact and to clear said groove, said at least one reciprocal moving means comprising means for biasing said reciprocal moving means out of contact with said groove, and means including a heat fusible alloy disc for causing horizontal movement of said at least one reciprocal moving means into and out of contact with said groove.

BRIEF DESCRIPTION OF THE DRAWING

The novel features and operation of the fire sprinkler head of the present invention will be better understood by reference to the drawing, in conjunction with reading the following specification, in which.

DETAILED DESCRIPTION OF THE INVENTION AND THE PREFERRED EMBODIMENTS

Figure 1:
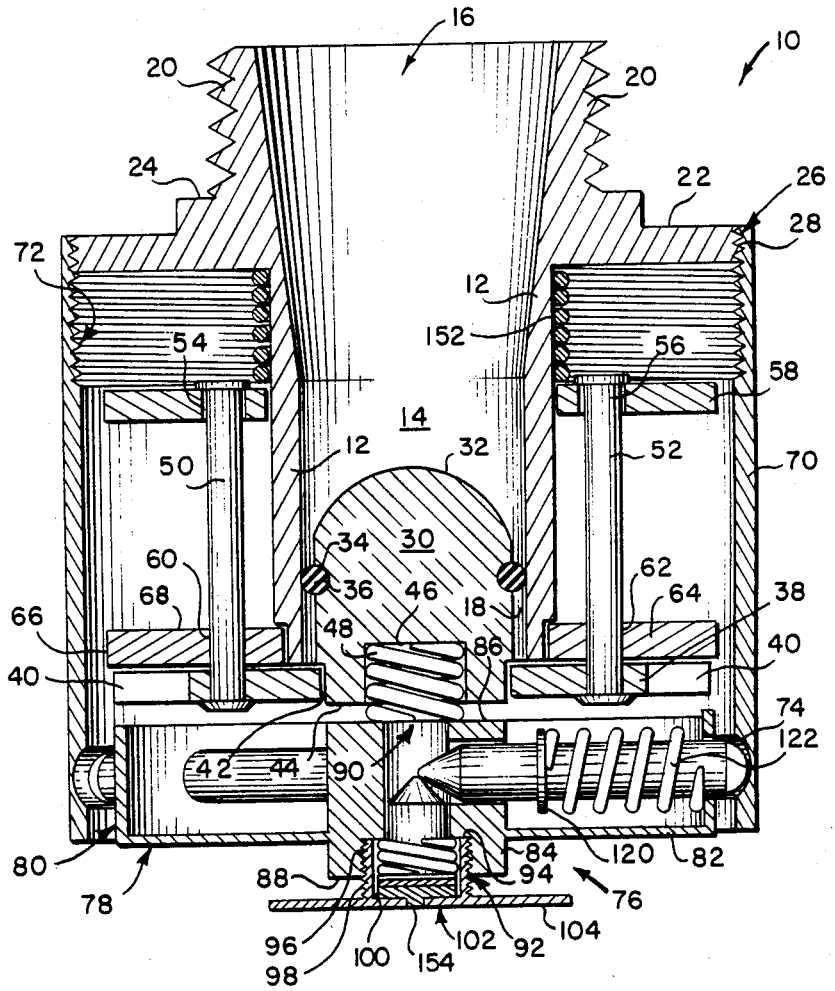
FIG. 1 is a schematic vertical, cross-sectional view of a sprinkler head according to the invention.

Referring now to the drawing, there is shown in FIG. 1 thereof fire sprinkler head 10, according to the invention, which can, if desired, be essentially concealed in the ceiling of a room. Sprinkler head 10 comprises an elongated, vertically disposed, body member 12 having a tubular-shaped central passageway 14 therein defined by an inlet end 16 and outlet end 18. Inlet end 16, as shown in FIG. 1, is provided with an external thread pattern 20 for connection of the sprinkler head 10 to a conventional overhead fire sprinkler system through an internally threaded female socket, not shown.

The elongated body member 12 is provided, adjacent the inlet end 16, with a horizontally disposed, outwardly extending, circular-shaped flange 22 having a circular-shaped shoulder 24 thereon. The vertically disposed surface 26 defined by the circumferential surface of flange 22 is provided with a thread pattern 28, the purpose for which, if not obvious from the drawing, will be later described.

As will be readily appreciated by reference to FIG. 1 of the drawing, passageway 14, in the upstanding inlet end of body member 12, tapers inwardly to a predetermined point defining an inverted truncated cone. Then, passageway 14 becomes of cylindrical shape, this diameter then continuing to outlet end 18. Thus, in accordance with well known properties of fluid flow, when the fire extinguishing liquid passes through passageway 14, its velocity increases in the lower extending portion of the body member, because of the passageway being narrowed, attendant with a somewhat decreased pressure resulting in a highly suitable discharge flow from outlet end 18. The most optimum dimensions of the passageway 14 can readily be determined by those skilled in the art, and depend to some extent upon the rate of discharge flow desired in the fire extinguishing fluid, it's pressure, and flow pattern.

The outlet end 18 is closed by an elongated, circular-shaped valve plug 30 which is provided, as shown in FIG. 1, with a dome-shaped end 32 which intrudes into outlet end 18. Valve plug 30 is provided with an annular groove 34 adjacent the dome-shaped end, for location of O-ring 36 for providing a positive seal against water, or other fire extinguishing liquid, leakage from the outlet end, all according to conventional techniques. It will be appreciated, however, that other valve constructions can be used in the practice of this invention, if desired.

The valve plug 30 is centrally located on, and fixedly secured to, a circular-shaped deflector plate 38, the peripheral edge of which is provided with a plurality of horizontally disposed, outwardly extending, spaced-apart teeth 40. These teeth are of uniform dimension and size and are uniformly spaced one from the other around the circumferential edge of deflector plate 38, all an accordance with requirements established by Underwriters Laboratories, Inc. In general, however, a suitable deflector plate will be provided with 24 teeth spaced about its circumference, each of which is approximately 1/16" at the outer edge and approximately 1/8" in depth. When fire extinguishing water is discharged from outlet end 18, it strikes deflector plate 38, teeth 40 providing the desired spray pattern on the fire. As shown in the drawing, the bottom end of valve plug 30 is located in circular-shaped opening 42 located centrally in deflector plate 38. The bottom circumferential edge of the valve plug and the circumferential surface of opening 42 are each provided with a thread pattern, not shown for sake of clarity, for threading the valve plug into the deflector plate; however, it will be appreciated that other conventional means of securing the valve plug to the deflector plate can be used, if desired. In the bottom surface 44 of valve plug 30, there is provided a circular-shaped dead bore 46 in which is located a coiled spring 48 (in its compressed mode in FIG. 1), the purpose for which will later be disclosed.

Attached to deflector plate 38 are parallel spaced-apart struts 50, 52 which extend vertically upwardly, being attached at their respective top ends 54, 56 to annular ring, or strut directing member, 58 which surrounds the elongated body member 12. As shown in FIG. 1, struts 50, 52 pass through, and are slideable in respective circular-shaped openings 60, 62 provided in annular-shaped horizontally disposed flange 64, and on a diameter thereof. Thus, the valve plug 30, deflector plate 38, struts 50, 52, and annular ring 58 act, in combination, as an assembly, the struts 50, 52 being moveable vertically upwardly and downwardly, a predetermined distance, to provide that the outlet end 18 of the passageway 14 is in the open or closed mode, as desired. The limit of the vertical movement upwardly of struts 50, 52, is determined by the bottom surface 66 of annular flange 64 and downwardly by the top surface 68 of that flange. The optimum length of struts 50, 52 will be determined by the vertical distance desired for deflector plate 38 to be located from outlet end 18 when the valve plug assembly is in the open mode, in order to obtain the desired fire extinguishing fluid flow pattern.

The flange 64 can be provided as an integral part of body member 12, during its manufacture, or provided in a separate manufacturing operation, as desired. In the latter event, it can be attached permanently to body member 12, in accordance with various conventional techniques. The main consideration is that flange 64 be provided in horizontal disposition, relative to the vertically disposed body member 12.

As seen in FIG. 1, the elongated body member 12 and the valve assembly is located within a cylindrical-shaped body shell 70, provided at its top open end, on the inner circumferential surface, with a thread pattern 72 extending downwardly from the top end a predetermined distance. Adjacent the bottom end of the body shell 70 there is provided a groove 74 which extends around the inner circumferential surface, the purpose for which will soon be disclosed. Located within body shell 70, at the bottom end thereof, as will be seen by reference to FIG. 1, there is provided a locking mechanism, or keeper assembly, 76, the purpose for which, in operative mode, is to maintain the valve assembly in position to close the outlet end 18 of body member 12, thereby preventing discharge of fire extinguishing liquid, until desired, at the onset of a fire. As will be better appreciated by the disclosure hereinafter, the locking mechanism 76, in its operative mode contacts the annular groove 74 at three, uniformly spaced locations.

Figure 3:
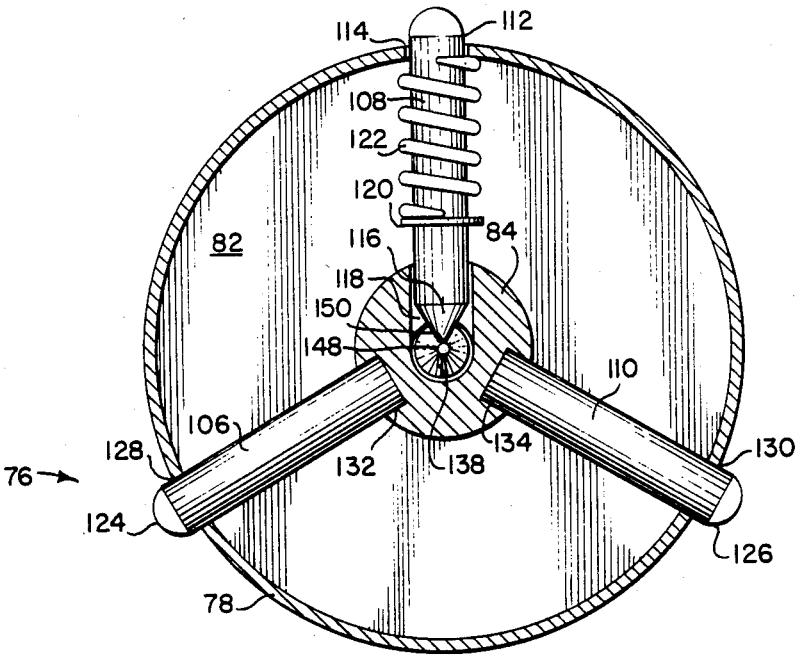
FIG. 3 is a top plan view of the locking mechanism of the fire sprinkler head shown in FIG. 2 showing the horizontally disposed elongated locking rod in operative position.

The locking mechanism 76, as shown, comprises a horizontally disposed housing 78 having a vertically disposed cylindrical-shaped side wall 80, being open at the top thereof and provided with a horizontally disposed circular-shaped closure 82, at the bottom. This closure can be formed integral with the cylindrical-shaped side wall 80 during manufacture, or separately formed and later secured thereto by conventional techniques, as desired. Located centrally within housing 78 is a circular-shaped body member 84, the top surface 86 of which terminates in the same horizontal plan as does cylindrical-shaped side wall 80. The circular-shaped body member 84 extends below closure 82, as shown in the drawing, for a predetermined distance, terminating at the bottom thereof in a horizontally disposed planar bottom surface 88, parallel to closure 82 and top surface 86. The circular-shaped body member 84 is provided with a centrally located, vertically extending, circular-shaped bore 90 which terminates in a plane with closure 82 and contacts with a further centrally located, circular-shaped bore 92 of somewhat greater diameter providing a horizontally disposed annular surface 94, the purpose for which will soon be disclosed, if not already made obvious by the drawing. The bore 92 is provided on its circumferential surface with an internal thread pattern 96 which mates with the external thread pattern 98 provided on the cylindrical-shaped, vertically disposed body member 100 of heat cup 102, which is open at the top thereof and closed at the bottom by planar, horizontally disposed, circular-shaped end member 104. This end member is of substantially greater diameter than body member 100 and acts as a heat absorbing surface, as will be more fully later disclosed. Referring to FIG. 3, it will be seen that there are provided in housing 78 three elongated, horizontally disposed, cylindrical-shaped rods 106, 108, and 110. The elongated rod 108 is mounted so as to be capable of predetermined, horizontal, reciprocal movement, the contact end 112 of which is located in, and extends through, the circular-shaped opening 114 in side wall 80. The operative end 116, i.e., the opposite end, of elongated rod 108 is mounted in cylindrical-shaped opening 118 located in body member 84, in direct opposition to circular-shaped opening 114. Located on, and fixedly secured to, elongated rod 108 is a snap ring 120 for holding coiled spring 122 in its compressed state against the inner surface of side wall 80, when elongated rod 108 is moved horizontally outwardly, whereby the contact end 112 intrudes into groove 74 of body shell 70, as hereinafter more fully explained. The coiled spring 122, moreover, is normally under sufficient compression whereby to cause elongated rod 108 to be biased to its retracted position, out of contact with groove 74.

The elongated rods 106 and 110, as shown in this more preferred embodiment of the invention disclosed in FIG. 3, are fixedly located at their respective contact ends 124, 126, in, and extend through, circular-shaped openings 128 and 130, respectively, in side wall 80. The opposite ends of these rods are fixedly located in dead bores 132, 134 provided in the cylindrical-shaped body member 84. Thus, these rods 106 and 110, in combination with the body member 84, provide rigidity and strength to the locking mechanism. Most importantly, however, the contact ends 124, 126, along with contact end 112 of the elongated locking rod 108, provide contact between locking mechanism 76 and body shell 70, in the annular groove 74, at three uniformly spaced-apart locations, providing an effective means for maintaining the valve assembly in the closed mode, and valve plug 30 in the outlet, or discharge, end 118 of the body member 12, until onset of a fire.

The contact ends 112, 124, and 126 of elongated rods 108, 106, and 110, respectively, are each rounded and comformed to the outwardly disposed, rounded shaped of annular groove 74. As will be appreciated, the elongated rods, at their contact ends, should extend beyond side wall 80 equal distances, to provide that locking mechanism 76 is located centrally in the bottom opening of the body shell 70.

Figure 2:
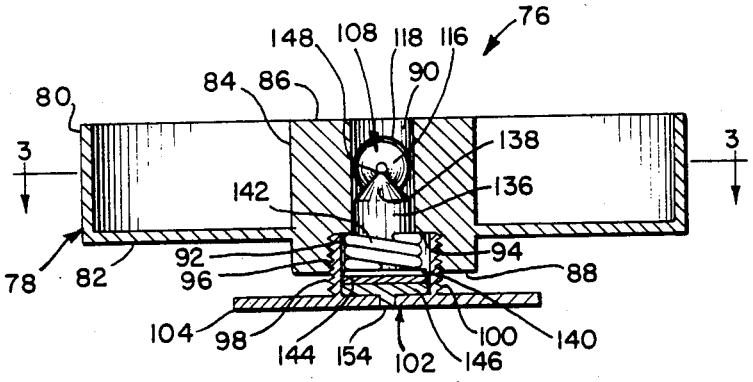
FIG. 2 is a view in cross-section of the locking mechanism of the sprinkler head shown in FIG. 1, taken at a angle 90° thereto.

Located in heat cup 102 is an elongated, vertically disposed, circular-shaped body member 136 capable of reciprocal movement in an up and down manner, having a top operative end 138 and a bottom contact end 140 terminating in a horizontally disposed, circular-shaped planar surface of somewhat greater diameter. Surrounding the elongated body member 136 is a coiled spring 142 the bottom end of which, as shown in the drawing, is supported by and on the annular-shaped surface provided at the bottom end 140. The top end of the coiled spring 142, as will be seen by reference to FIG. 2 of the drawing, rests against annular surface 94 whereby the spring 140 is compressed on threading heat cup 102 into bore 92.

The bottom end 140 of the vertically reciprocal member 136 rests on, and is supported by, a circular-shaped layer, or disc, of insulating material 144 which, in turn, is supported by a disc 146 of heat fusible alloy. This latter disc can be of any alloy or eutectic composition conventionally used in fire sprinkler heads, designed to melt, in general, in the range of from about 135° to 180° F.

The top operative end 138 of the vertically reciprocal member 136, like the operative end 116 of elongated locking rod 108, is of a conical-shape. Thus, the apex 148 of the conical-shaped operative end 138 will make essentially a linear-point, sliding contact with the conical-shaped operative end 116 and, in turn, the apex 150 of the conical-shaped operative end 116 will make essentially a linear-point sliding contact with the conical-shaped operative end 138, the reason for which will soon be hereinafter disclosed. These conical-shaped surfaces, most desireably are provided at a 45° angle, relative to the respective elongated bodies.

In assembling the locking mechanism 76 in the fire sprinkler head 10, first the valve assembly is pushed inwardly from its open mode into the body shell 70 where, upon doing so, coiled spring 152, located between annular ring 58 and flange 26, is compressed. Next, while maintaining the valve assembly in the closed position, the locking mechanism 76 is located within the bottom of body shell 70 so that the contact ends 112, 124, and 126 are directly opposite annular groove 74. Then, heat cup 102 is threaded inwardly whereby to cause elongated member 136 to move upwardly in bore 90 and the apex 148 of the operative conical-shaped end 138 to engage with the conical-shaped end 116 of the elongated locking rod 108, causing rod 108 to move horizontally outwardly, and the contact end 112 thereof, to engage the groove 74. It will be appreciated that, when elongated locking rod 108 is in the retracted position, the apex 148 of the operative conical-shaped end 138 will contact the conical-shaped operative end 116 of the locking rod at its base. Thus, on threading heat cup 102 inwardly, the apex 148 will slide on conical-shaped operative end 116 toward apex 150 thereof, at the same time causing the locking rod 108 to move horizontally outwardly, in engagement with groove 74. The tighter, in general, that heat cup 102 is threaded into circular-shaped member 84 the greater will be the outward horizontal movement of elongated locking rod 108. Hence, the tighter will be the contact between the locking mechanism 76 and the body shell 70. Also, the more compressed will be coiled springs 122 and 142.

As shown in FIG. 1 of the drawing, when locking mechanism 76 is in its operative position, the top surface 86 of body member 84 will cause coiled spring 48 to be compressed. Thus, as will be appreciated, this compressed spring provides a potential force directed downwardly against locking mechanism 76.

Figure 4:
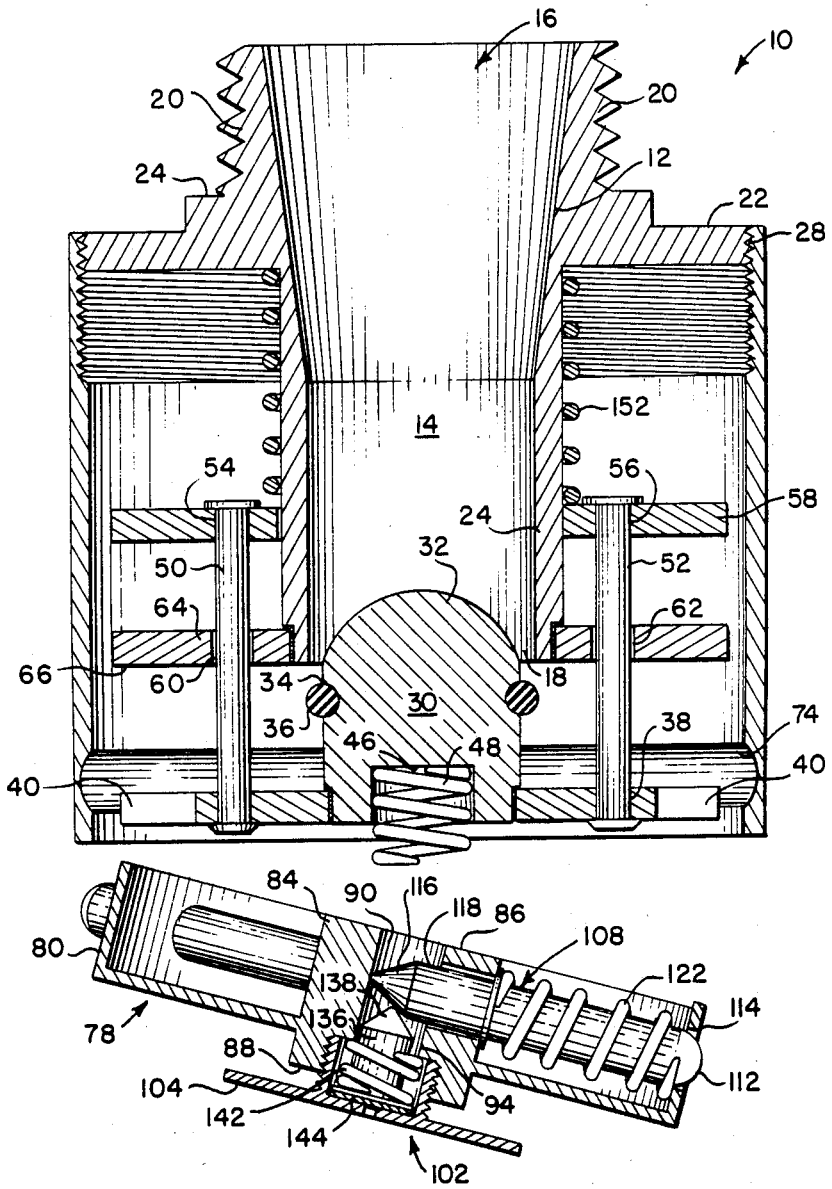
FIG. 4 is a view in cross-section of the fire sprinkler head, as shown in FIG. 1, showing the reaction of the locking mechanism to heat from a fire, and showing the valve assembly in the initial stage of operating to the open position.

In operation, as will be more particularly appreciated by reference to FIGS. 1 and 4 of the drawing, with the onset of a fire the rise in the ambient temperature surrounding the fire sprinkler head 10, particularly heat cup 102, will cause the heat fusible alloy disc 146 located in heat cup 102, to melt. On so melting, there is no longer any support provided by the heat fusible alloy disc to the vertically reciprocal member 136, and this member is then free to move vertically downwardly. This downward movement is made positive, and accelerated, by the potential force provided in the compressed coiled spring 142. With vertical member 136 free to move, there is no longer any resistance to elongated locking rod 108 moving horizontally to its normally retracted position. This is accomplished rapidly and positively through the potential force in compressed coiled spring 122, at which time the contact end 112 of elongated rod 108 frees itself from the confines of annular groove 74. When that occurs, coiled spring 48 is then free to expand and the potential force therein causes locking mechanism 76 to be pushed downwardly and free of the body shell bottom opening. The locking mechanism, as shown in FIG. 4, is caused to pivot downwardly, at an angle, as the result of the fixed contact ends 124, 126, located in the annular groove 74.

At the same time, once the locking mechanism 76 becomes inoperative, there is no longer any resistance to the valve assembly moving to its open mode. This movement is made positive, and more rapid, by the downwardly exerted force against the strut directing member, or annular ring, 58, released on the expansion of coiled spring 152. Thus, as will be appreciated, there will be provided quick and positive response in the valve assembly moving to its open mode, independent of any force against the valve plug by the contained fire extinguishing fluid.

Heat cup 102, as shown in the drawing, is desirably provided with a circular-shaped weep hole 154, in the bottom thereof, in order that the heat fusible alloy, on melting, can escape from the heat cup. Nevertheless, in general, the clearances in the heat cup between coiled spring 142, and member 136, etc. will be such that no weep hole necessarily need be provided. The heat cup 102, or at least end member 104, should be manufactured of relatively high heat conductive material, whereby to provide a relatively large surface area for absorbing and transferring ambient heat in the event of a fire to the heat fusible alloy disc. Heat transfer is confined essentially to the heat fusible alloy disc as the alloy disc 146 is backed-up with the disc 144 of conventional insulating material.

Although the invention, as disclosed herein, constitutes the most preferred embodiment thereof, it will be appreciated that various modifications can be made thereto. For example, rather than providing a dead bore 46 and a coiled spring 48 in the bottom of valve plug 30, the bottom surface of the valve plug can be provided instead with a dimple, i.e., an outwardly projecting rounded surface, that bears against top surfaces 86, when the locking mechanism is in its operative location. In that case, any downward force against locking mechanism 76 will be provided entirely by the potential force in compressed coiled spring 152. It will be appreciated also that elongated rods 106 and 110 need not be fixed but that such elongated rods can be made to reciprocate back and forth in a horizontal direction, the same as is disclosed for elongated locking rod 108. Thus, in that case, there will be provided three elongated, reciprocally horizontal, locking rods. And, when threading heat cup 102 in body member 84, the conical-shaped operative end 138 will function to cause outward horizontal movement of each of the locking rods at the same time. Moreover, in a somewhat less preferred embodiment of the invention, there need not be provided elongated rods 106 and 110. Instead, the contact ends 124 and 126 can merely be provided as outwardly extending projections permanently secured to cylindrical wall 80. In this case, housing 78 can, if desired, be a solid cast material wherein contact ends 124 and 126 are provided integral with the housing, as is body member 84.

In resetting the fire sprinkler head of the invention, as disclosed herein in FIG. 1, after the occurrence of a fire, only the coiled spring 48 and the locking mechanism will need be replaced, and in the case where a dimple is provided on the bottom surface of the valve plug 30, only the locking mechanism will need be replaced. Thus, the fire sprinkler head of the invention can be readily and easily restored to its operative condition, without need of special tools, and without removal of the sprinkler head from the fire sprinkler system.

Although not shown in the drawing, it will be appreciated that sprinkler head 10 can be installed in a ceiling with body shell 70 and the operating parts of the valve assembly concealed from view and, in such a manner that only the closure 82 and heat cup 102 of the locking mechanism are seen. In this case, the bottom closure 82 will be mounted flush with the ceiling.

Other modifications and changes, as will be understood, can be made in the invention and its form and construction without departing from the spirit and scope thereof. The embodiments disclosed herein are merely exemplary of the various modifications that the invention can take and the preferred practice thereof. It is not, however, desired to confine the invention to the exact construction and fixtures shown and described herein, but it is desired to include all such as properly come within the spirit and scope of the invention disclosed.

What I claim is:

1. Fire sprinkler head suitable for mounting in a concealed position in a ceiling in a residential dwelling comprising, in assembly:

(a) an elongated body member having a tubular-shaped central passageway therein defined by an inlet end to be connected to a water line and an outlet end for discharge of water onto a fire, an outwardly extending horizontally disposed, circular-shaped flange of predetermined diameter on said body member, adjacent said inlet end, defining a vertically disposed circumferential surface, a thread pattern being provided in said circumferential surface, and an outwardly extending, horizontally disposed, circular-shaped flange of a predetermined lesser diameter then said first named flange at said outlet end surrounding the said body member, two-spaced-apart openings being provided in said second named circular-shaped flange located on an imaginary diameter of said second named circular-shaped flange, and on opposite sides of said body member;

(b) an elongated cylindrical-shaped body shell of predetermined diameter and length having an outer and inner circumferential surface and defining a top opening and a bottom opening, a thread pattern being provided on the inner circumferential surface of said body shell extending downwardly from said top opening to a desired predetermine distance along its length toward the bottom opening, said thread pattern matching with that provided on the said circumferential surface of said first named flange, and a groove being provided in the inner circumferential surface of said body shell adjacent the said bottom opening;

(c) a valve assembly operable to a closed position to close off the outlet end of the said body member whereby the discharge of water is prevented until the onset of a fire and operable to an open position from the said closed position allowing water to be discharged from the outlet end, said valve assembly comprising in combination a horizontially disposed circular-shaped deflector plate, a plurality of horizontially extending teeth being provided uniformly and in spaced-apart location around the circumference of said circular-shaped deflector plate, a valve body member located centrally on and supported by said deflector plate which, when the valve assembly is in its closed position, intrudes into said outlet end of the tubular-shaped passageway, means being located on said valve body member for providing positive seal of said outlet end when the said assembly is in the closed position, an annular-shaped strut directing member surrounding said elongated, main body member and capable of reciprocal linear movement up and down along a predetermined portion of the length of said elongated body member, two spaced-apart vertically disposed, elongated struts of predetermined length connected to said strut directing member at their top ends on an imaginary diameter that coincides with the diameter on which said two spaced-apart opening are located in said second-named flange, said struts each extending through respective said spaced-apart openings and being connected at their bottom ends to said deflector plate;

(d) a compressible member surrounding said elongated body member and being located between said first named outwardly extending flange on said elongated body member and said strut directing member; and (e) a locking means for keeping said valve assembly in the closed position and said compressible member in its compressed state until the onset of a fire and the attainment of a predetermined ambient temperature comprising a horizontally disposed means which comprises means providing contact with said groove in the body shell at three uniformally spaced-apart locations, at least one of which means contacting the said groove being an elongated rod capable of reciprocal, horizontal movement back and forth whereby to contact and to clear said groove, said at least one reciprocal moving means comprising means for biasing said reciprocal moving means out of contact with said groove, and means including a heat fusible alloy disc for causing horizontal movement of said at least one reciprocal moving means into and out of contact with said groove.

2. Fire sprinkler head suitable for mounting in a concealed position in the ceiling in a residential dwelling according to claim 1 wherein said at least one means capable of reciprocal horizontal movement is an elongated rod having a groove contacting end and an operative end for contact with and by said means for horizontally moving the said horizontally reciprocal moving rod, said biasing means being a coiled spring in operative association with said at least one elongated rod, and means provided on said at least one rod adjacent said operative end for keeping said coiled spring compressed when said at least one rod is caused to move horizontally outwardly into contact with said groove whereby said at least one rod is biased normally to a position out of contact with the said groove.

3. Fire sprinkler head suitable for mounting in a concealed position in the ceiling in a residential dwelling according to claim 1 wherein the said tubular-shaped central passageway in said elongated body member is of a cylindrical shape.

4. Fire sprinkler head suitable for mounting in a concealed position in the ceiling in a residential dwelling according to claim 1 wherein the central passageway in the said body member at the inlet end is in the shape of an inverted truncated cone and at the outlet end is of cylindrical shape.

5. Fire sprinkler head suitable for mounting in a concealed position in the ceiling in a residential dwelling according to claim 1 wherein the said valve body member is of elongated circular-shape and an o-ring member; is provided thereon and surrounds said valve body member for providing a positive seal when the said valve assembly is in the closed position.

6. Fire sprinkler head suitable for mounting in a concealed position in the ceiling in a residential dwelling according to claim 1 wherein the said first named circular-shaped flange is formed integral with said body member.

7. Fire sprinkler head suitable for mounting in a concealed position in the ceiling in a residential dwelling according to claim 1 wherein the said circular-shaped flange at the outlet end of the elongated body member is of annular shape and is fixedly secured to the body member.

8. Fire sprinkler head suitable for mounting in a concealed position in the ceiling in a residential dwelling according to claim 1 wherein the strut directing member, the second named flange on the body member, and the said deflector plate are all of the same diameter.

9. Fire sprinkler head suitable for mounting in a concealed position in the ceiling in a residential dwelling according to claim 1 wherein the said horizontally disposed means of the locking means comprises a cylindrical-shaped housing having a vertically extending side wall, said housing having a diameter somewhat less than the internal diameter of said cylindrical-shaped body shell whereby said housing can be located in the bottom opening of the body shell, means associated with the said housing of the locking mechanism providing contact with the groove in said body shell at three uniformly spaced-apart locations, at least one of which contacting means is an elongated rod having a contact end and an operative end and being capable of reciprocal horizontal movement back and forth whereby to contact and to clear said groove, and means capable of vertical up and down movement contacting said at least one elongated rod at the said operative end including a heat fusible alloy for horizontally moving said at least one elongated rod from its normally biased location into contact with said groove.

10. Fire sprinkler head suitable for mounting in a concealed position in the ceiling in a residential dwelling according to claim 9 wherein a planar, circular-shaped closure is provided in the bottom of the said housing, a centrally disposed circular-shaped opening is provided in said closure, a centrally disposed, cylindrical-shaped body member is fixedly provided in said opening extending vertically upwardly and downwardly a predetermined distance on each side of said closure and having a top and bottom surface, a cylindrical-shaped bore in said top surface, a cylindrical-shaped bore in said bottom surface of somewhat greater diameter communicating with said bore in the top surface of said cylindrical-shaped body member, at least one opening being provided in the said cylindrical-shaped body member, at least one opening being provided in said cylindrical-shaped vertically extending side wall in direct opposition to said at least one opening in said cylindrical-shaped body member, said at least one elongated, horizontally disposed reciprocating rod being provided in said housing so that its operative and contact ends extend through respective said openings in the said side wall and the said body member, a coiled spring being located on and surrounding said at least one elongated rod, means provided on said at least, one rod adjacent said operative end for maintaining said coiled spring in compressed state whereby said elongated rod is biased horizontally inwardly out of contact with the said groove, and said means including the heat fusible alloy disc comprises an elongated vertically disposed member capable of vertical up and down movement having a top operative end and a bottom contact end which functions to cause said at least one elongated rod to move horizontally outwardly when it is moved vertically upwardly, and allows said elongated rod to move horizontally inwardly when it moves vertically downwardly.

11. Fire sprinkler head suitable for mounting in a concealed position in the ceiling in a residential dwelling according to claim 10 wherein the said means comprising the heat fusible alloy disc is a heat cup comprising a cylindrical-shaped upwardly extending body member and a planar, horizontally disposed end member of somewhat greater diameter, an external thread pattern is provided on said upwardly extending body member, and a thread pattern is provided on the cylindrical-shaped bore provided in the bottom surface of the centrally disposed body member fixed in said closure, whereby said heat cup can be threaded into said last-named body member, and said vertically disposed member can be caused to move vertically upwardly.

12. Fire sprinkler head suitable for mounting in a concealed position in the ceiling in a residential dwelling according to claim 11 wherein a coiled spring is located in operative association with said vertically disposed member located in said heat cup and said spring is compressed when said heat cup is threaded upwardly in the said body member whereby to bias the vertically disposed member vertically downwardly.

13. Fire sprinker head suitable for mounting in a concealed position in the ceiling in a residential dwelling according to claim 12 wherein the heat fusible alloy disc is located in said heat cup below said vertically disposed elongated reciprocal member and acts as a support therefor and prevents said reciprocal member from moving downwardly, as long as said alloy disc remains unmelted.

14. Fire sprinkler head suitable for mounting in a concealed position in the ceiling in a residential dwelling according to claim 13 wherein the operative ends of said at least one elongated rod and said vertically reciprocating member are both of a conical-shape, and the apex of the conical-shaped operative end of said vertically reciprocating member is in sliding contact with the conical-shaped operative end of said elongated rod whereby on being caused to move vertically upwardly, the elongated vertically reciprocating member causes the elongated horizontally disposed rod to move outwardly in contact with the groove in the body shell.

15. Fire sprinkler head suitable for mounting in a concealed position in the ceiling in a residential dwelling according to claim 14 wherein a circular-shaped opening is provided in said deflector plate, the valve body member is of elongated cylindrical shape having a planar botrom, and said valve body member is fixedly located in said circular-shaped opening in the deflector plate, a cylindrical-shaped vertically-extending dead bore is provided in the planar bottom of said valve body member, and a coiled spring is provided in said dead bore, whereby on being located in the bottom opening of the body shell, the said top surface of the body member in the locking means causes said coiled spring to be compressed, providing a potentially vertically downward force against the locking means.

* * * * *